US012338608B2

(12) United States Patent
Ye et al.

(10) Patent No.: US 12,338,608 B2
(45) Date of Patent: Jun. 24, 2025

(54) ASSEMBLED PANEL ASSEMBLY

(71) Applicant: XIAMEN LOTA INTERNATIONAL CO., LTD., Fujian (CN)

(72) Inventors: Liming Ye, Fujian (CN); Shuanglin Bai, Fujian (CN); Xinzong Huang, Fujian (CN); Chuanbao Zhu, Fujian (CN)

(73) Assignee: Xiamen Lota International Co., Ltd., Xiamen (CN)

( * ) Notice: Subject to any disclaimer, the term of this patent is extended or adjusted under 35 U.S.C. 154(b) by 190 days.

(21) Appl. No.: 18/354,317

(22) Filed: Jul. 18, 2023

(65) Prior Publication Data

US 2024/0200314 A1 Jun. 20, 2024

(30) Foreign Application Priority Data

Dec. 14, 2022 (CN) ..... 202211605887.8
Dec. 14, 2022 (CN) ..... 202223355343.9

(51) Int. Cl.
*E03C 1/04* (2006.01)

(52) U.S. Cl.
CPC ..... *E03C 1/0401* (2013.01)

(58) Field of Classification Search
CPC ..... E03C 1/0401
USPC ..... 248/694; 137/605
See application file for complete search history.

(56) References Cited

U.S. PATENT DOCUMENTS 8,627,850 B1 * 1/2014 Booker ..... E03C 1/0408 4/597
10,745,896 B2 * 8/2020 Ye ..... E03C 1/0408
11,913,201 B2 * 2/2024 Ruzza ..... E03C 1/023

* cited by examiner

*Primary Examiner* — Anita M King
(74) *Attorney, Agent, or Firm* — Knobbe, Martens, Olson & Bear, LLP

(57) ABSTRACT

An assembled panel assembly, which is used for in-wall bath faucet and comprises a panel, configured as a shell and has a main surface, on which receiving hole(s) is/are provided; a baseplate, located at one side of the panel and has corresponding engagement portion(s) for being mated with the receiving hole(s), which engagement portion(s) is/are configured as flange(s) delimiting engagement hole(s); housing(s), each configured to receive a button set, located at the other side of the panel, and detachably engaged with the engagement portion of the baseplate so as to secure it to the panel in the manner of being opposite to the baseplate, and the button set is configured to be moved in the axial direction relative to the engagement hole of the baseplate to drive the open or close of a button valve element. The assembled panel assembly, which provides innovative structural design, enables a panel with flat surface being independently applied to the in-wall bath faucet and optimizes the function of the button set by reasonable cooperation of the panel assembly. Such a panel is provided that can satisfy the demands for many kinds of surface processes on it in the post-process, which overcomes many defects presented in an uneven surface panel in the prior arts.

10 Claims, 8 Drawing Sheets

ASSEMBLED PANEL ASSEMBLY

TECHNICAL FIELD

The present disclosure relates to the technical field of bath device, and in particular, to an assembled panel assembly applied to a in-wall bath faucet.

BACKGROUND

The panel assembly which is applied to the in-wall bath faucet in prior arts generally comprises button hump(s) that presents adverse impact on the subsequent surface treatment process of the panel, such as, polishing, wiredrawing, multicolor collocation and the like, which leads to the subsequent surface treatment process being more complex, time-consuming and low efficiency, and thereby adversely affecting the efficient quantity production of the traditional integral type panel. Furthermore, the metallic integral type panel assembly is high cost, and the plastic panel assembly is difficult to be widely accepted by user due to its undesirable process strength and appearance.

Thus, there are requirements to improve the panel assembly applied to the in-wall bath faucet in the relevant technical field so as to further optimize the performance of manufacture, mount, use and the like for improving or solving the problem presented in the prior arts.

SUMMARY

Therefore, it is an object of the present disclosure to provide an assembled panel assembly, thereby overcoming the disadvantages of the prior arts.

To implement above object, this invention provides a assembled panel assembly for in-wall bath faucet, wherein it comprises: a panel, configured as a shell and having a main surface, on which receiving hole(s) is/are provided; a baseplate, located at one side of the panel and having corresponding engagement portion(s), which is/are configured as flange(s) delimiting engagement hole(s); housing(s), each configured to receive a button set, located at the other side of the panel, and detachably engaged with the engagement portion of the baseplate so as to be secured to the panel in the manner of being opposite to the baseplate, and the button set is configured to be moved in the axial direction relative to the engagement hole of the baseplate to drive the open or close of a button valve element for controlling on-off of the fluid.

As a preferred embodiment, the button set comprises a button body, which is received in the housing and engaged to the engagement portion in anti-rotation way by partially extending through the engagement hole of the baseplate, and the button body is configured to be able to move in the axial direction of the engagement hole and rest against the button valve element at the side of baseplate away from the panel, thereby actuating the open or close of button valve element.

As a preferred embodiment, the button body comprises: a head received in the housing and a shaft extending through the engagement hole in the axial direction of the head and having a smaller diameter relative to the head; the assembled panel assembly also comprises: limiting member(s), snapped to the shaft at the side of the shaft away from the head; elastic member(s), sleeved on the shaft, and one end thereof rests against the head in its axial direction, and the other end thereof rest against the limiting member, so that the button body can be elastically approached to or kept away from the baseplate in the axial direction to close or open the button valve element.

As a preferred embodiment, the button set also comprises: a button cover, engaged with the button body in the anti-rotation way at the side where the head of the button body is located; fastener(s), engaged with the button cover so as to secure the button cover to the button body.

As a preferred embodiment, the housing is engaged with the engagement portion of the baseplate and received in an annular gap delimited by the engagement portion and the receiving hole, wherein the engagement portion of the baseplate extends through the receiving hole, thereby positioning the panel relative to the housing.

As a preferred embodiment, the main surface of the panel is also provided with a mounting hole for mounting a temperature regulator, wherein the baseplate has a corresponding mating portion mated with the mounting hole, and the mounting hole and the mating portion are positioned to each other by mating a notch with a bumping.

As a preferred embodiment, the baseplate is provided with rib(s) at the side facing the panel, which is/are configured to keep clear of the receiving hole(s) on the panel.

As a preferred embodiment, the button body at the periphery of the head is provided with a protrusion extending toward the shaft: the housing comprising: a connection portion, conformal to the annular gap; an outer annular part, located at the outer circumference of the connection portion and having a diameter greater than the receiving hole; an inner annular part, located at the inner circumference of the connection portion and being engaged with the engagement portion, and a recess is delimited by the inner annular part, the connection portion and the outer annular part together; the recess of the housing is axially opposite to the protrusion of the button body and provides a guidance for the protrusion to be moved toward the recess in the axial direction.

As a preferred embodiment, the shaft of the button body is engaged to the engagement portion of the baseplate in the anti-rotation way by mating a first groove and the first protruded rib.

As a preferred embodiment, the shaft of the button body and the button cover are engaged with each other in the anti-rotation way at the side that the head of the button body is located by mating a second groove and the second protruded rib.

A part of other features and advantages of the present disclosure will be apparent to the skilled person in the art after reading the disclosure, while the other part will be described in the following specific embodiment in combination with the drawings.

BRIEF DESCRIPTION OF DRAWINGS

Hereinafter, the embodiments of the present disclosure will be described in detail in combination with drawings, wherein.

DETAILED DESCRIPTION

Figure 1:
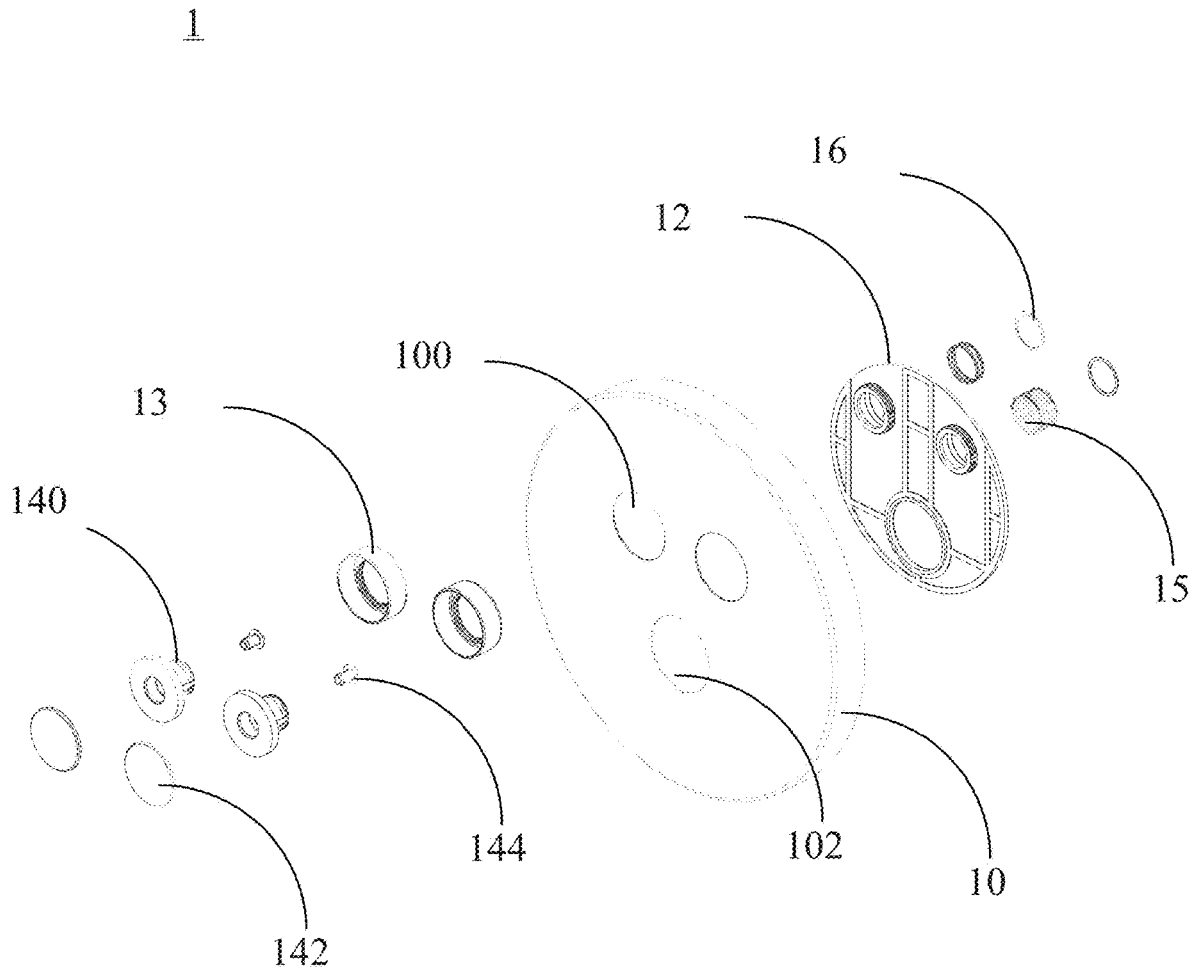
FIG. 1 is an exploded schematic view of the assembled panel assembly according to present disclosure.

Now the schematic solutions of the assembled panel assembly in present disclosure will be described in detail. Although some drawings are provided to illustrate some embodiments of the present disclosure, these drawings may not necessarily be depicted in scale, and some features may be enlarged, removed or cut off in part to show and explain the disclosure of the present disclosure better. The positions of some elements in the drawings may be adjusted as desired without influencing the technical effect. The phrase "in the drawings" or the like presented in the description may not refer to all the drawings or examples.

Some orientation terms, e.g. "inner", "outer", "upper", "lower" and other orientation terms, as used hereinafter for describe the drawings will be understood as having their normal meanings and indicating those directions as involved when the drawings are viewed normally. Basically, the orientation terms as stated in the present specification will be interpreted according to the routine directions as understood by the skilled person in the art, unless otherwise specified.

The terms "first", "the first", "second", "the second" and the like as used in the disclosure do not represent any order, amount or importance in this invention, but rather are used to differentiate one element from other elements.

In this text, in terms of the term "general", it means that it is unnecessary for the parameter or value referred to be accurately accomplished, and the deviation or variation (in which the deviation or variation comprises, such as, tolerance, measuring error, measuring accuracy limit and other factors known by the skilled artisan) can be presented without prejudicing the mount of the technical effects expectantly provided by the technical feature.

FIG. 1 is an exploded schematic view of the assembled panel assembly 1 according to present disclosure. The assembled panel assembly 1 is in particular suitable for the in-wall bath faucet. As shown in FIG. 1, the assembled panel assembly 1 comprises a panel 10, a baseplate 12, a housing 13, a button set 14, elastic members 15 and limiting member 16.

Specifically, the panel 10 is configured as shell and in particular a decoration panel. The panel 10 has a primary plane, on which one or more receiving holes 100 are provided. The number of the receiving hole 100 is optionally at least one, preferably two and can be adapted for the skilled artisan as desired. Usually, two receiving holes 100 are applied to two button set 14 each for controlling the shower (fixed shower head or handed shower head) and faucet (such as a bathtub faucet) and the relevant structural parts. The primary plane of the panel 10 is also provided with a mounting hole 102 for mounting a temperature regulator, which is usually used for regulating the temperature of water passing therethrough so as to meet the water temperature demands of user.

Figure 3:
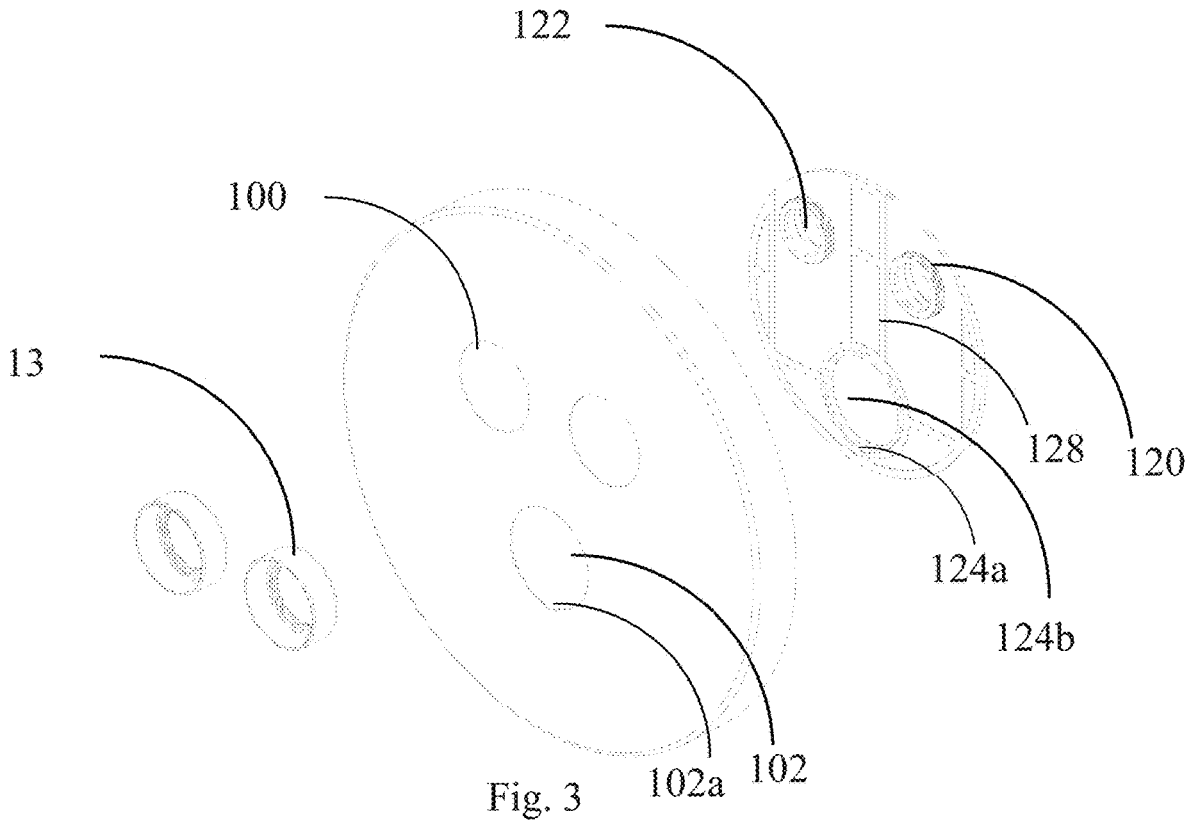
FIG. 3 is a partially exploded view of the assembled panel assembly according to present disclosure.

Referring to FIG. 3, the baseplate 12 is provided at one side of the panel 10, in particular at the side of the panel 10 proximate to the wall to which it is to be mounted, as shown in the right of FIG. 1. The baseplate 12 is provided with engagement portions 120 at one side facing the panel 10, and the engagement portions 120 are in positional correspondence relationship and mated with the receiving holes 100. The engagement portions 120 are configured as flanges defining engagement holes 122.

Figure 2:
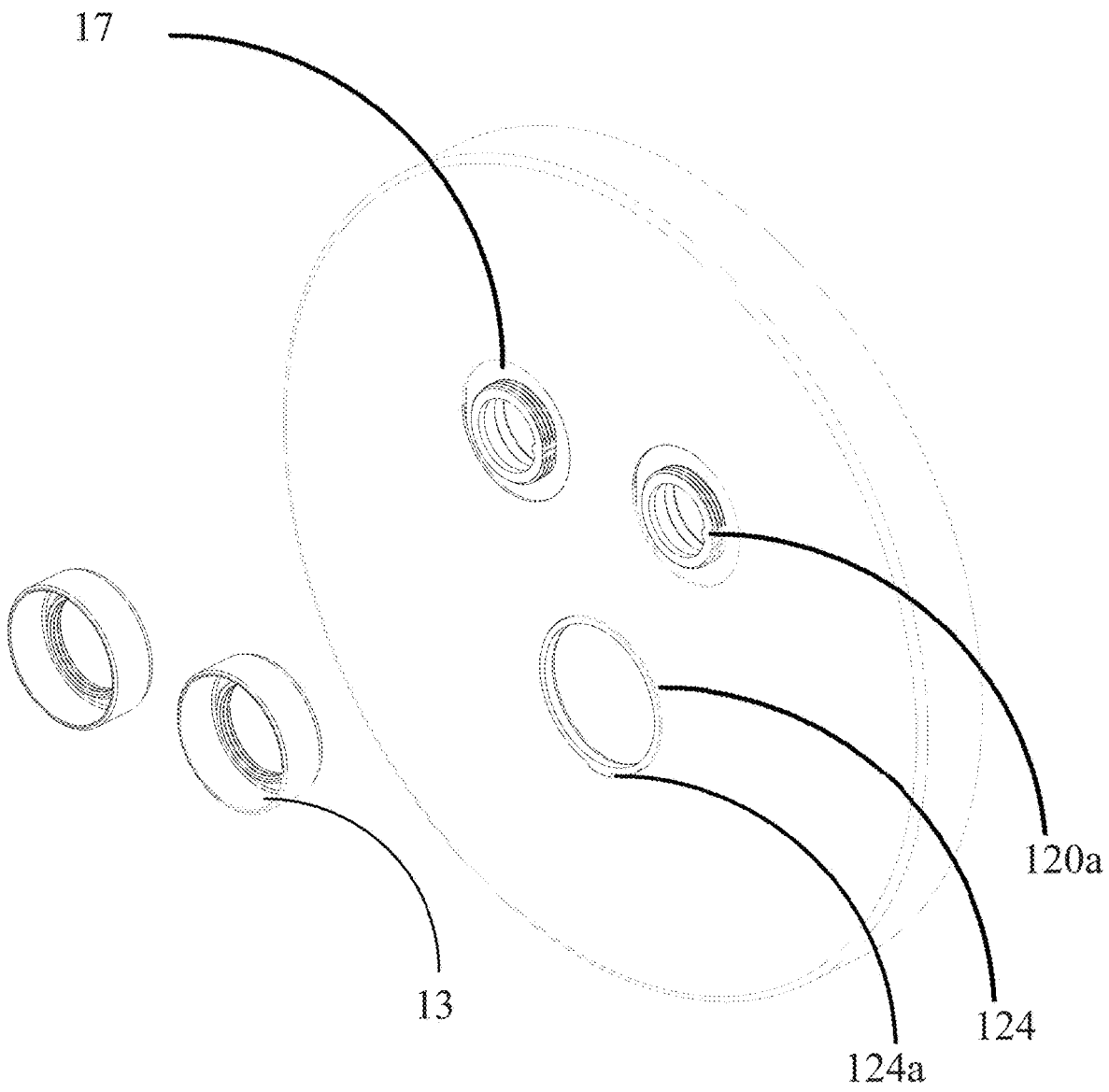
FIG. 2 is a partially assembling drawing of the assembled panel assembly according to present disclosure.

Referring to FIGS. 1, 5, 9 and 10, the foresaid housing 13 is used for receiving the button set 14, and configured as annular structure. The housing 13 comprises a connection portion 130, an outer annular part 132, and an inner annular part 134, wherein the connection portion 130 is conformal with an annular gap 17 (as shown in FIG. 2) formed by the engagement portion 120 (i.e., the flange) and the receiving hole 100 of the panel 10, and the outer annular part 132 is located at the outer circumference of the connection portion 130 and the diameter thereof is slightly greater than that of the receiving hole 100 so as to resist against the edge of the receiving hole 100, thereby limiting the housing 13 in the annular gap 17, and the inner annular part 134 is located at the inner circumference of the connection portion 130 and engaged to the engagement portion 120 (i.e., the flange) of the baseplate 12. The height of the outer annular part 132 is greater than that of the inner annular part 134 in the axial direction, and the height of the inner annular part 134 is greater than that of the connection portion 130 in the axial direction. A recess 136 is delimited by the inner annular part 134, the connection portion 130 and the outer annular part 132 together, which recess is located between the inner annular part 134 and the outer annular part 132 and disposed opposite to a protrusion 140*c* of the button body 140 set forth in following text.

Figure 5:
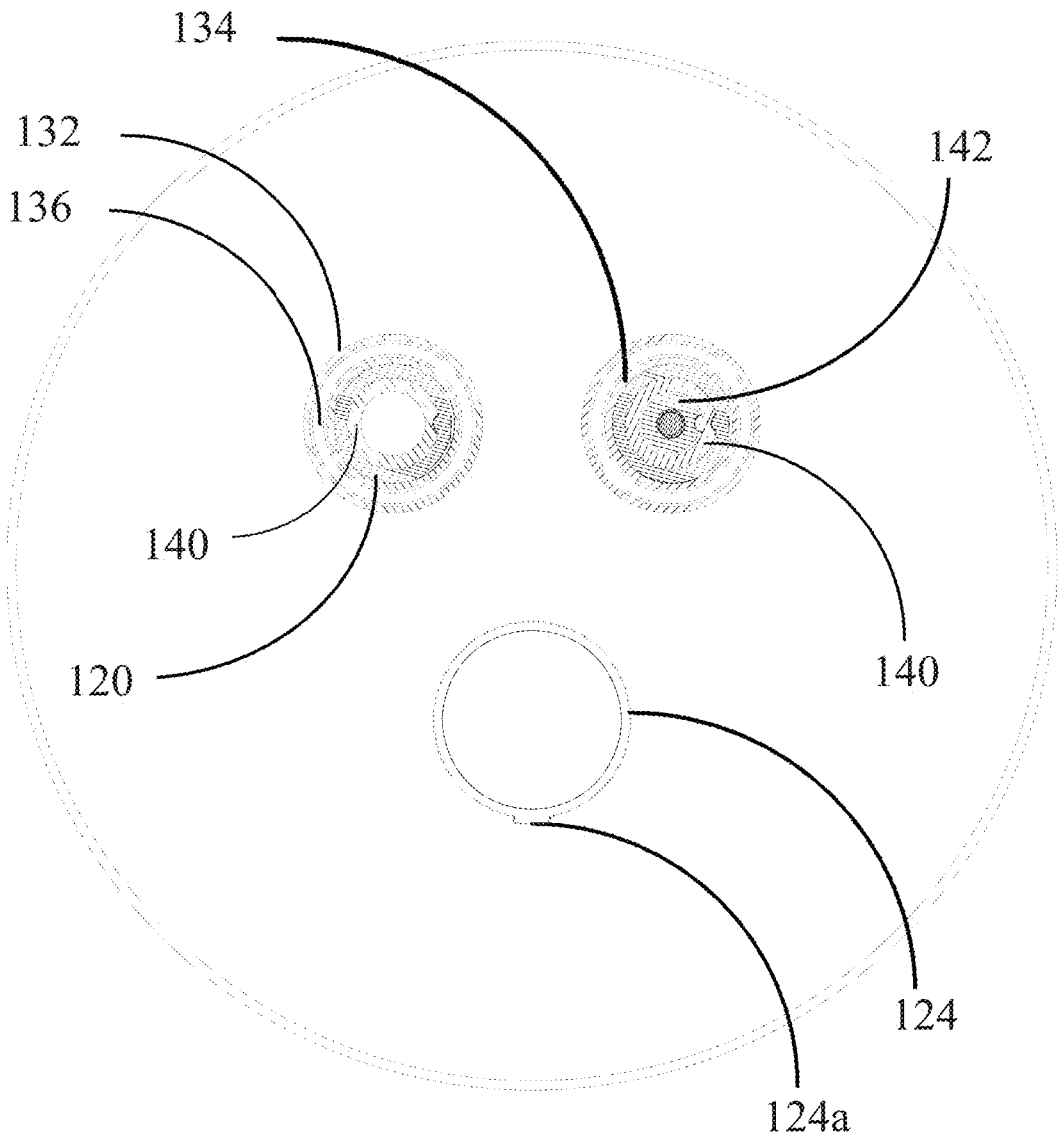
FIG. 5 is a front view of the panel assembly in FIG. 3 being completely assembled.
Figure 10:
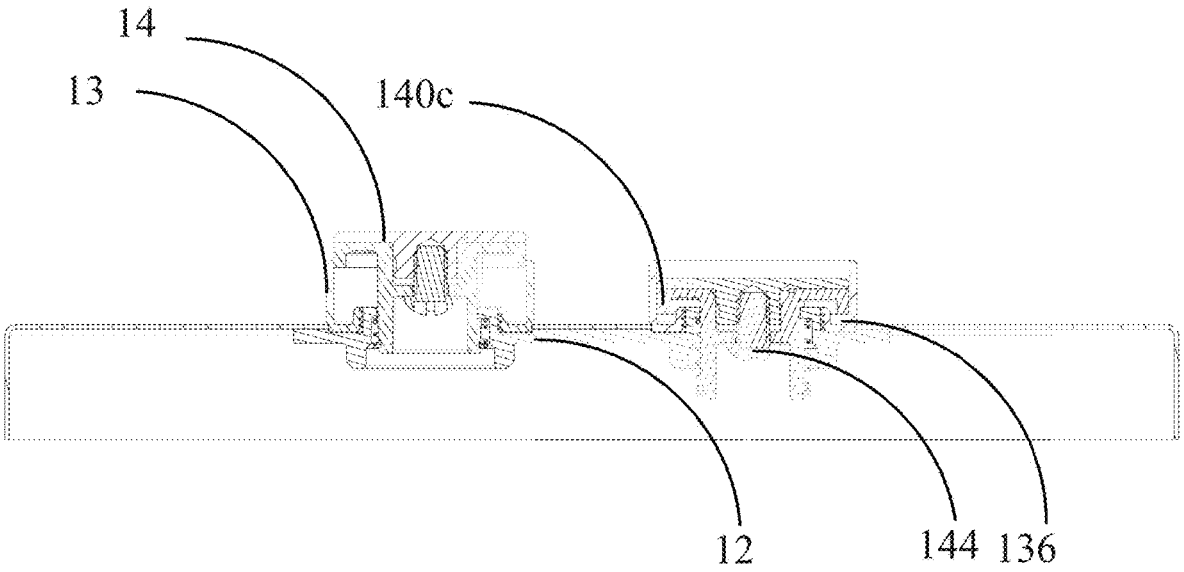
FIG. 10 is a sectional view of the assembled panel assembly according to present disclosure being a finished assembled state.

As shown in FIGS. 3, 5 and 10, the button set 14 is used for controlling the open and close of the valve associated therewith, in particular the button valve element. The housing 13 is at one side of the panel 10 facing away from the wall, and detachably engaged to the engagement portion 120 of the baseplate 12, so that the housing 13 and the baseplate 12 are secured to the panel 10 opposite to each other. The foresaid button set 14 is contained in the housing 13 and movable in the axial direction relative to the engagement hole 122 of baseplate 12, thereby actuating the open or close of the button valve element associated therewith so as to control the on-off of fluid.

As shown in FIGS. 1 and 3, the baseplate 12 has a mating portion 124 for being correspondingly mated with the mounting hole 102 which is used for mounting the temperature regulator and disposed on the main surface of the panel 10. The mating portion 124 is a protruded ring delimiting a mating hole 124*b*, which is correspondingly provided relative to the mounting hole 102. The mounting hole 102 of the panel 10 and the protruded ring of the baseplate 12 are positioned relative to each other by means of mating a notch 102*a* and a bumping 124*a* each being disposed in the circumferential direction. Optionally, the notch 102*a* and the bumping 124*a* are exchangeable on the panel 10 and baseplate 12.

Referring to FIG. 1 or FIG. 3, the baseplate 12 is also provided with ribs 128 on its one side facing the panel 10. The ribs 128 are disposed around the engagement portions 120 (i.e., flanges) in certain spacing, which should be configured as follows, the annular gap 17 formed by the flanges and the receiving hole 100 do not interfere with the ribs 128 after the flanges being inserted into the receiving holes. By providing the ribs 128, there is an axial distance between the baseplate 12 and the panel 10 when they are assembled together, and the axial distance can receive a part of the housing 13 so as to position the housing 13.

Figure 6:
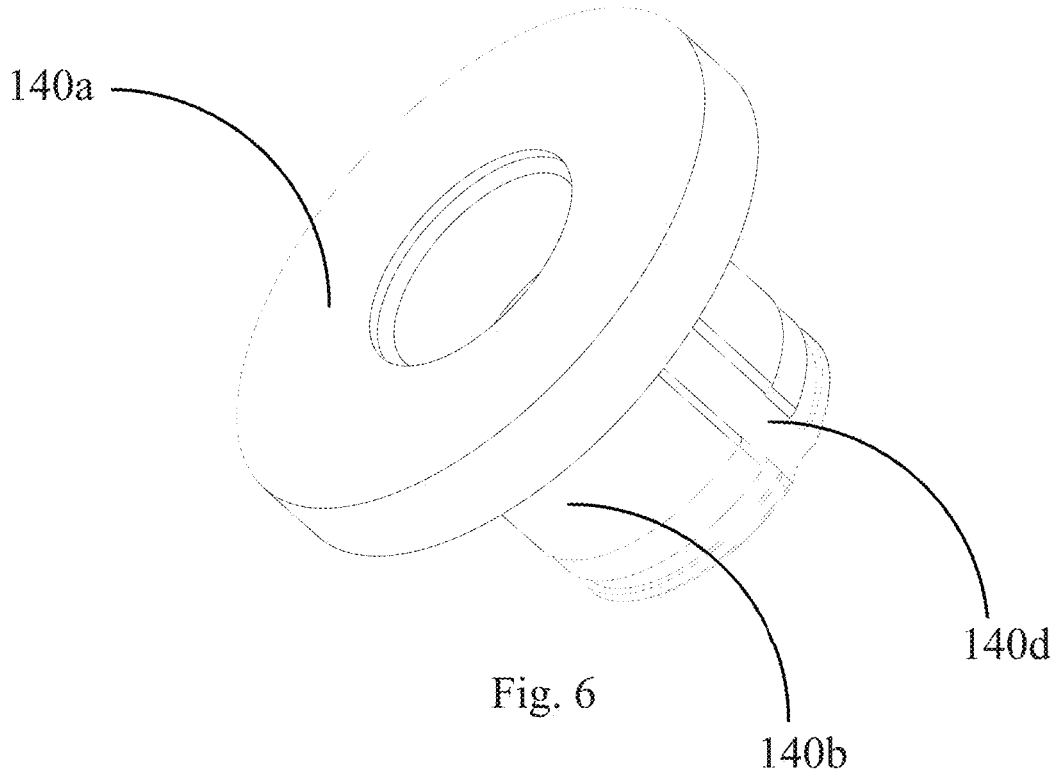
FIGS. 6-7 are perspective views of the button body of the assembled panel assembly according to present disclosure.
Figure 8:
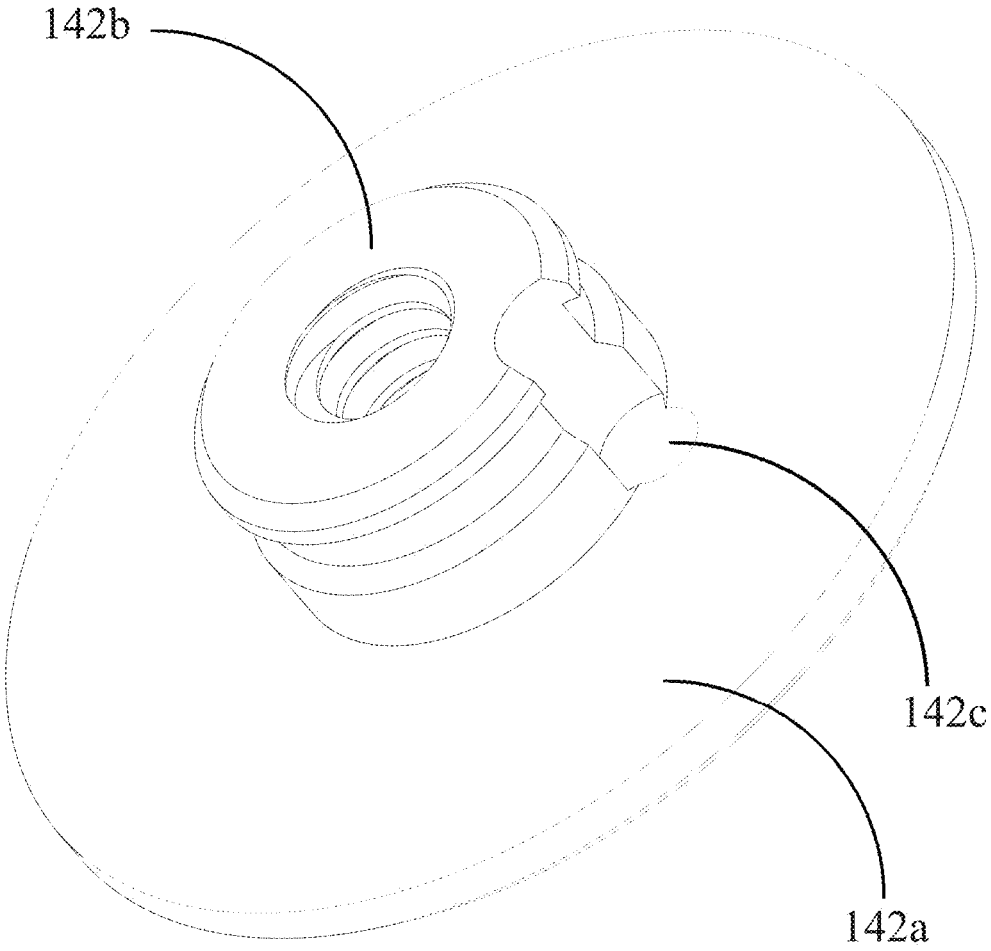
FIG. 8 is a bottom perspective view of the button cover of the assembled panel assembly according to present disclosure.
Figure 9:
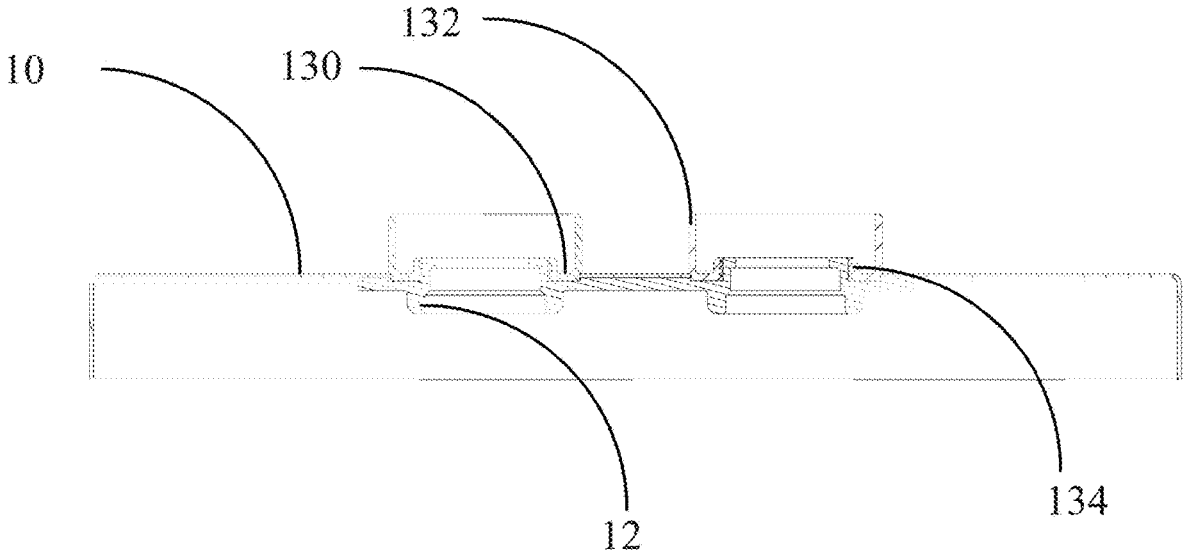
FIG. 9 is a sectional view of the assembled panel assembly in FIG. 4 being partially assembled.

Referring to FIGS. 1, 6 and 8, the button set 14 comprises a button body 140, a button cover 142, and a fastener 144. When the button set 14 is assembled with the housing 13, the button body 140 is received in the housing 13 and partially passed therethrough so as to extend through the engagement hole 122 of the baseplate 12, thereby being engaged to the engagement portion 120 (i.e., flange) defining the engagement hole in the anti-rotation way. Specifically, the shaft 140*b* of the button body 140 is engaged to the flange of the baseplate 12 in the anti-rotation way by mating the first groove 140*d* and the first protruded rib 120*a* relative to each other. The first groove 140*d* and the first protruded rib 120*a* are located in the axial direction of the structural member on which they are provided. Optionally, the positions of the first groove 140*d* and the first protruded rib 120*a* can be interchangeable. The number the first groove 140*d* and the first protruded rib 120*a* can be adapted for the skilled artisan as desired. The button body 140 can be moved in the axial direction of the engagement hole 122 of the baseplate 12, and rest against the button valve element at the side of the baseplate 12 away from the panel 10, thereby being interconnected with the button valve element for controlling the on-off thereof. The button cover 142, the housing 13 and the panel 10 can be optionally made of metal, such as, copper, aluminum alloy, zinc alloy and the like. The button body 140 and the baseplate 12 can be optionally made of non-metal, such as ABS, POM and the like.

Figure 7:
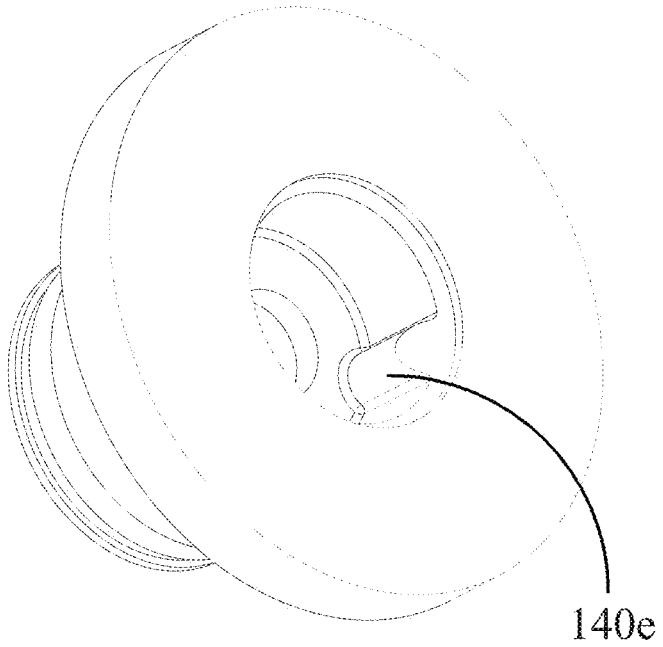

Specifically, as shown in FIGS. 7 and 8, the button body 140 comprises a head 140*a* and a shaft 140*b*, which button body is in shape of screw, and the head 140*a* is formed by extending in the radial direction of the shaft 140*b*. The head 140*a* of the button body 140 is received in the housing 13, and the shaft 140*b* thereof extends in the axial direction of the head 140*a* and has a diameter smaller than the head 140*a*. The assembled panel assembly 1 further comprises limiting members 16 and elastic members 15, wherein the limiting member 16 is located at the side of the shaft 140*b* away from the head 140*a* and snapped to the shaft 140*b* in particular the snap slot disposed on the circumference of the shaft 140*b*, and the elastic member 15 is sleeved on the shaft 140*b*, one end of the elastic member 15 rests against the engagement portion 120 (i.e., flange, in particular the limit portion of the flange extending inwards in the radial direction) of the baseplate 12, and the other end thereof rests on the limiting member 16. The limiting member 16 limits the compression space of the elastic member 15 and limits the distance of the button set 14 moving in the axial direction so as to avoid it falls off from the baseplate 12.

Herein, the limiting member 16 can be optionally a snap ring, and the elastic member 15 can be optionally a spring, such as a helical spring. It is certain that it is conceivable for the skilled artisan to choose other suitable limiting member 16 and elastic member 15 under the teaching from present disclosure, which does not depart from present disclosure. The head 140*a* of the button body 140 can be elastically approached to or kept away from the baseplate 12 (i.e., the button body 140 is elastically approached to or kept away from the wall) in the axial direction, and the foresaid movements of the button body 140 is associated with the on-off of the button valve element.

Referring to FIG. 8, the button cover 142 mentioned above comprises a cover 142*a* and base 142*b*, wherein the cover 142*a* is circular plate part, and the base 142*b* is a stem part. The base 142*b* is disposed with the second groove 142*c* that is disposed in the radial direction and extends in the axial direction of the base. The second groove 142*c* is correspondingly disposed with the second protruded rib 140*e* at one side of the head 140*a* of the button body 140 and mated with it. The button body 140, in particular the shaft 140*b* thereof at one side of the head 140*b*, is engaged to the button cover 142 in the anti-rotation way by means of mating the respective second groove 142*c* and the second protruded rib 140*e*. The second groove 142*c* and the second protruded rib 140*e* are disposed in respective axial direction. The cover 142*a* of the button cover 142 is usually adhered with indicative mark at its surface for presenting the button's function for use, such as for controlling shower head or faucet. The anti-rotation design of the button cover 142 and the button body 140 efficiently avoids the rotation of the button cover 142 so that the indicative mark attached thereon is still in correct position to facilitate the user getting identification.

Referring to FIGS. 1 and 10, the fastener 144 is used for securing the button cover 142 to the button body 140. The shaft 140*b* of the button body 140 is configured as a substantially hollow structure and has a boss extending inwards in the radial direction of the shaft 140*b*. The boss is provided with a fastener hole for the fastener going therethrough and the fastener 144 is optionally a screw. The stem of the screw is engaged to the base 142*b* of the button cover 142 through the fastener hole, and the screw head of the screw rest against the boss, thereby securing the button cover 142 to the button body 140.

Referring to FIG. 10 again, the button body 140 at the periphery of its head is also provided with a protrusion 140*c* extending towards the shaft. The protrusion 140*c* is disposed opposite to the recess 136 (as mentioned above) delimited by the housing 13 and provides guidance for the protrusion 140*c* of the button body 140 to be moved toward the recess 136 of the housing 13 in the axial direction.

As shown in FIGS. 2 and 5, after the baseplate 1 is fitted to the panel 10, an annular gap 17 is delimited together by the engagement portion 120 (i.e., flange) of the baseplate 12 and the receiving hole 100 of the panel 10, at which the housing 13 is located and engaged to the engagement portion 120 of the baseplate 12, so that the housing 13 and the baseplate 12 are positioned to two sides of the panel 10 opposite to each other.

The specific assembly process of the foresaid assembled panel assembly 1 is described as follows.

The baseplate 12 is mounted to the panel 10, and the engagement portion 120 of the baseplate 12 is correspondingly inserted into the receiving hole 100. The mating portion 124 of the baseplate 12 corresponds to the mounting hole 102 of the panel 10, and the bumping 124*a* of the mating portion 124 is snapped to the notch at the periphery of the mounting hole 102, thereby positioning the baseplate 12 relative to the panel 10.

Figure 4:
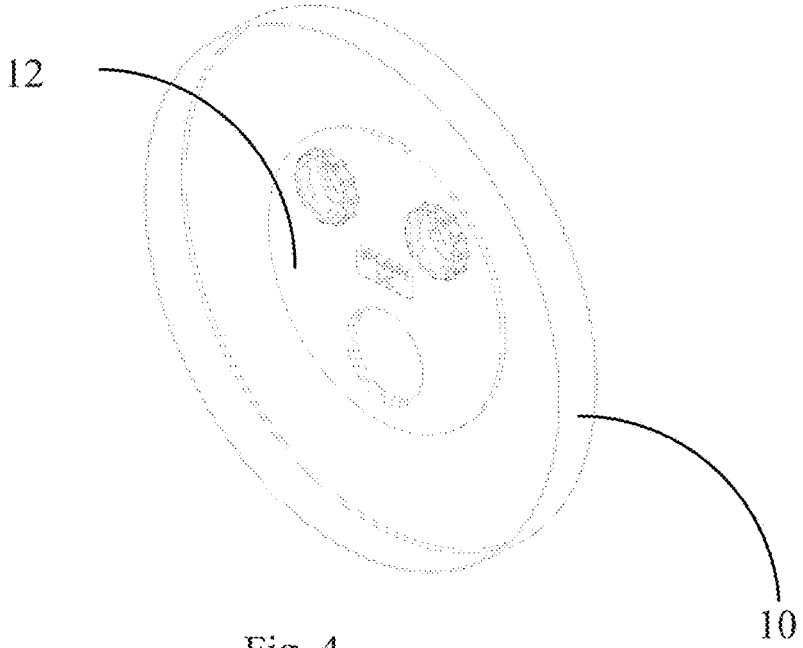
FIG. 4 is a rear view of the panel assembly in FIG. 3 being partially assembled.

The housing 13 is engaged with the engagement portion 120 in the screw connection way, so that the housing is positioned in the annular gap 17 delimited by the receiving hole 100 of the panel 10 and the engagement portion 120 of the baseplate 12, and the housing 13 rests against the periphery of the receiving hole 100 of the panel 10 at its circumferential direction. The housing 13 and the baseplate 12 are located at two sides of the panel 10, respectively, and secured to the panel 10 opposite to each other. The schematic view of the finished assembly of the housing 13, the panel 10 and the baseplate 12 is as the FIGS. 4 and 9.

The button cover 142 is mounted to the button body 140 and engaged with the button body 140 by means of mating the second axial groove 142*c* of the base 142*b* with the second axial protruded rib 140*e* of the button body 140 on one side of the head 140*a*. Then, the screw stem of the fastener 144 (such as screw) is engaged with the base 142*b* of the button cover 142 by going through the fastener hole formed in the interior of the button body 140. The screw rest against the boss, thereby securing the button cover 142 to the button body 140.

The elastic member 15 (such as helical spring) is sleeved on the shaft 140*b* of the button body 140, and the snap ring is then snapped into the snap slot on the shaft 140*b*. One end of the elastic member 15 rests against the engagement portion 120 (i.e., flange, in particular the radial limit portion defined by the flange) of the baseplate 12, and the other end of the elastic member 15 rests against the snap ring, thereby elastically positioning the button set 14 in the axial direction relative to the baseplate 12. The finished assembled panel assembly 1 is as shown in FIG. 10, wherein it also shows the configuration of the button set 14 when it is in a closed state or in an open state, which corresponds to the open and close of the button valve element for controlling on-off of the fluid.

The present disclosure provides an assembled panel assembly, which provides innovative structural design that enables a panel with flat surface being independently applied to the in-wall bath faucet and optimizes the function of the button set by reasonable cooperation of the panel assembly. An independent panel is provided that can satisfy the demands for many kinds of surface processes on it in the post-process, which overcomes many defects presented in the panel since the button is formed on its surface in prior arts, and improves the assembly and use of the panel assembly since the cooperation of the baseplate and the housing ensures that they can be securely positioned to the panel.

Although the invention is described through limited quantities embodiments, it is understood that the invention is not limited by such disclosed embodiments. Rather, any changes, modifications, replacements or equal devices which are not described previously are incorporated to revise the invention, however, which are equivalent to the spirit and scope of the invention. Furthermore, while various embodiments of the invention have been described, it is understood that the aspect of the invention can merely include some of the embodiments. Therefore, the invention is not regarded to be limited by the aforesaid description, however it is only limited by the appended claims.

LIST OF REFERENCE NUMERALS

1—panel assembly
10—panel
100—receiving hole
102—mounting hole
102*a*—notch
12—baseplate
120—engagement portion
120*a*—first protruded rib
122—engagement hole
124—mating portion
124*a*—bumping
124*b*—mating hole
128—rib
13—housing
130—connection portion
132—outer annular part
134—inner annular part
136—recess
14—button set
140—button body
140*a*—head
140*b*—shaft
140*c*—protrution
140*d*—first groove
140*e*—second protruded rib
142—button cover
142*a*—cover body
142*b*—base
142*c*—second groove
144—fastener
15—elastic member
16—limiting member
17—annular gap

What is claimed:

1. An assembled panel assembly for in-wall bath faucet, comprising:

a panel configured as a shell and having a main surface, on which receiving hole(s) is/are provided;

a baseplate located at one side of the panel and having corresponding engagement portion(s) with the receiving hole(s), wherein the engagement portion(s) is/are configured as flange(s) delimiting engagement hole(s);

housing(s) configured to receive a button set and located at another side of the panel (10), and to detachably engage with the engagement portion(s) of the baseplate to be secured to the panel opposite to the baseplate, wherein the button set is configured to be moved in an axial direction relative to the engagement hole(s) of the baseplate to drive an opening or closing of a button valve for controlling on-off of a fluid.

2. The assembled panel assembly according to claim 1, wherein the button set comprises a button body, which is received in the housing(s) and is engaged to the engagement portion(s) in an anti-rotation manner by partially extending through the engagement hole(s) of the baseplate, and the button body is configured to be able to move in the axial direction of the engagement hole(s) and to rest against the button valve at a side of the baseplate away from the panel, thereby actuating the opening or closing of the button valve.

3. The assembled panel assembly according to claim 2, wherein the button body comprises: a head received in the housing and a shaft extending through the engagement hole(s) in an axial direction of the head and having a smaller diameter relative to the head;

wherein the assembled panel assembly further comprises:

limiting member(s), snapped to the shaft at a side of the shaft away from the head;

elastic member(s), sleeved on the shaft, and one end thereof axially rests against the head, and the other end thereof rest against the limiting member(s), so that the button body can be elastically accessed to or kept away from the baseplate in the axial direction to close or open the button valve.

4. The assembled panel assembly according to claim 3, wherein the button set further comprises:

a button cover, engaged with the button body in an anti-rotation way at a side of the button body where the head of the button body is located;

fastener(s), engaged with the button cover so as to secure the button cover to the button body.

5. The assembled panel assembly according to claim 3, wherein the housing is engaged with the engagement portion(s) of the baseplate and is received in an annular gap delimited by the engagement portion(s) and the receiving hole(s) when the engagement portion(s) of the baseplate extend(s) through the receiving hole(s), thereby positioning the panel relative to the housing.

6. The assembled panel assembly according to claim 3, wherein the main surface of the panel is further provided with a mounting hole for mounting a temperature regulator, wherein the baseplate has a corresponding mating portion mated with the mounting hole, and the mounting hole and the mating portion are positioned to each other by mating a notch with a bumping.

7. The assembled panel assembly according to claim 1, wherein the baseplate is provided with rib(s) at a side facing the panel, wherein the rib(s) is(are) configured to keep clear of the receiving hole(s) on the panel.

8. The assembled panel assembly according to claim 5, wherein the button body at a periphery of the head is provided with a protrusion extending toward the shaft, wherein the housing comprises:

a connection portion conformed to the annular gap;

an outer annular part located at an outer circumference of the connection portion and having a diameter greater than the receiving hole(s);

an inner annular part located at an inner circumference of the connection portion and engaged with the engagement portion(s), wherein a recess is jointly delimited by the inner annular part, the connection portion and the outer annular part;

wherein the recess of the housing is axially opposite to the protrusion of the button body and is used for guiding the protrusion to be moved toward the recess in the axial direction.

9. The assembled panel assembly according to claim 3, wherein the shaft of the button body is engaged to the engagement portion(s) of the baseplate in an anti-rotation way by mating a first groove with a first protruded rib.

10. The assembled panel assembly according to claim 3, wherein the shaft of the button body and a button cover are engaged with each other in an anti-rotation way at a side of the button body where the head of the button body is located by mating a second groove with a second protruded rib.

* * * * *